United States Patent [19]

Manaka et al.

[11] Patent Number: 4,995,366

[45] Date of Patent: Feb. 26, 1991

[54] METHOD FOR CONTROLLING AIR-FUEL RATIO FOR USE IN INTERNAL COMBUSTION ENGINE AND APPARATUS FOR CONTROLLING THE SAME

[75] Inventors: Toshio Manaka, Katsuta; Masami Shida, Mito, both of Japan

[73] Assignee: Hitachi, Ltd., Tokyo, Japan

[21] Appl. No.: 404,649

[22] Filed: Sep. 8, 1989

[30] Foreign Application Priority Data

Sep. 19, 1988 [JP] Japan ..... 63-232507

[51] Int. Cl.[5] ..... F02D 41/10; F02D 41/12

[52] U.S. Cl. ..... 123/492; 123/493

[58] Field of Search ..... 123/478, 480, 492, 493, 123/494

[56] References Cited

U.S. PATENT DOCUMENTS 4,357,923 11/1982 Hideg ..... 123/492
4,388,906 6/1983 Sugiyama et al. ..... 123/492
4,667,640 5/1987 Sekozawa et al. ..... 123/480 X
4,852,538 8/1989 Nagaishi ..... 123/492
4,903,668 2/1990 Ohata ..... 123/480 X
4,905,653 3/1990 Manoka et al. ..... 123/480 X

*Primary Examiner*—Tony M. Argenbright
*Attorney, Agent, or Firm*—Antonelli, Terry, Stout & Kraus

[57] ABSTRACT

An estimating execution for an inner surface portion adhesion fuel amount is practiced distinctlly and independently to an execution processing for a basic fuel injection amount. A correction coefficient to be multiplied by the basic fuel injection amount is calculated in accordance with the estimation execution for the inner wall surface portion adhesion fuel amount. The correction coefficient is multiplied by the basic fuel injection amount. Since the fuel injection amount is corrected in accordance with the estimated inner surface portion adhesion fuel amount, an air-fuel ratio during a transitional period of an engine can be maintained at a desirable value.

10 Claims, 5 Drawing Sheets

METHOD FOR CONTROLLING AIR-FUEL RATIO FOR USE IN INTERNAL COMBUSTION ENGINE AND APPARATUS FOR CONTROLLING THE SAME

BACKGROUND OF THE INVENTION

The present invention relates to a method for controlling air-fuel ratio in an internal combustion engine and an apparatus for controlling the same and, more particularly, to a method and apparatus for controlling the fuel supply amount for a combustion chamber of an internal combustion engine. The invention is particularly concerned with control of the air-fuel ratio of an air-fuel mixture being supplied into the combustion chamber of the internal combustion engine during a transitional period in which an operational condition of the internal combustion engine changes.

The present invention relates to a method for controlling air-fuel ratio in an internal combustion engine and an apparatus for controlling the same, incorporating a plurality of sensors and an electronic control unit, or an electronic control computer which receives signals from various sensors, and which controls fuel injection and provides control of the internal combustion engine.

In a method for controlling air-fuel ratio in an internal combustion engine equipped with a fuel injection and control system, air and an appropriate amount of fuel is supplied by the fuel injection and control system during various and diverse operational conditions of the internal combustion engine so as to provide good engine operational characteristics, and an air-fuel ratio control apparatus operates in accordance with such an air-fuel ratio control method.

In an electric spark ignition type gasoline internal combustion engine for use in an automotive vehicle, a part of an injected fuel being supplied into the gasoline internal combustion engine adheres to an inner wall surface portion of an intake air flow passage and becomes an adhesion fuel film.

Such a fuel adhesion phenomenon will be explained referring to FIG. 7 which is a partial cross-sectional view showing a part of a gasoline internal combustion engine including an intake pipe, an intake valve, and a combustion chamber. Intake air flows into the combustion chamber from an intake pipe 8 passing through a value port in the vicinity of an intake valve 31. The gasoline fuel is injected into the above stated air flow from an injector 13.

A part of the injected fuel being supplied to the gasoline internal combustion engine 7 adheres to an inner wall portion of the intake air flow passage in the intake pipe 8 and forms an adhesion fuel film 32.

When the internal combustion engine an is operated at a stable operational condition internal for a long period, the fuel which adheres to an inner wall surface portion of an intake air flow passage in an intake pipe and the amount of the fuel evaporated from the intake air flow passage wall are equal or balanced; accordingly, a stable air-fuel ratio of the air-fuel mixture for the internal combustion engine can be maintained.

However, during a transient state when an operational condition (for example, engine speed, torque etc.) changes during operation of the internal combustion engine, then the air-fuel ratio of the mixture being supplied into the internal combustion engine is often incorrect.

To solve the above stated air-fuel ratio control problem, there has been developed a technique for controlling air-fuel ratio as described in U.S. Pat. No. 4,388,906. Namely, the amount of the fuel being supplied into the internal combustion engine is controlled or corrected in accordance with a calculation result obtained through the following model calculation formulas (1) and (2) which are described in the above stated U.S. patent.

$$\frac{dM_f}{dt} = X \cdot G_f - \frac{1}{\tau} \cdot M_f \tag{1}$$

$$G_f = \frac{\frac{Q_a}{(A/F)_o} - \frac{1}{\tau} \cdot M_f}{1 - X} \tag{2}$$

wherein, $G_f$: fuel supply amount $Q_a$: intake air flow amount $(A/F)_o$: target air-fuel ratio $M_f$: fuel adhesion amount X: fuel adhesion rate $\tau$: evaporation time constant.

In the above stated conventional air-fuel ratio control technique, the amount of fuel to be injected into the combustion chamber of the internal combustion engine is calculated in accordance with the above stated model calculation formulas (1) and (2) in which the amount $M_f$the fuel which adheres to an inner wall surface portion of an intake air flow passage is estimated.

However, since it is necessary to perform the calculation processing in an electronic control unit which is selected taking into the consideration the required accuracy of the calculation of the fuel injection amount, a large burden is imposed on a central processing unit (CPU) in the electronic control unit. Further, there is a problem that it is necessary to provide a large memory capacity for programs and data in the electronic control unit.

SUMMARY OF THE INVENTION

An object of the present invention is to provide a method and apparatus for controlling air-fuel ratio in an internal combustion engine and, wherein a suitable air-fuel ratio can be maintained through compensation during a transitional period of operation of the internal combustion engine.

Another object of the present invention is to provide a method and apparatus for controlling air-fuel ratio in an internal combustion engine and, wherein the air-fuel ratio during a transitional period of operation of the internal combustion engine can be maintained at a desirable value.

A further object of the present invention is to provide a method and apparatus for controlling air-fuel ratio in an internal combustion engine wherein the fuel injection amount is controlled or corrected according to an inner wall surface portion adhesion fuel amount.

A further object of the present invention is to provide a method and apparatus for controlling air-fuel ratio in an internal combustion engine wherein the burden on a central processing unit (CPU) in the electronic control unit can be reduced.

A further object of the present invention is to provide a method and apparatus for controlling air-fuel ratio in an internal combustion engine and wherein the memory capacity of the central processing unit (CPU) in the electronic control unit can be reduced.

In order to attain the above stated objects of the present invention, the fundamental principles of a method and apparatus for controlling an air-fuel ratio in an internal combustion engine and summarized as follows:

(i) An estimation execution value for an inner wall surface portion adhesion fuel amount is calculated distinctly and independently from the calculation processing for a basic fuel injection amount.

(ii) A correction coefficient multiplied by the above stated basic fuel injection amount is calculated in accordance with the above stated estimation execution value for the inner wall surface portion adhesion fuel amount.

(iii) The above stated correction coefficient is multiplied by the above stated basic fuel injection amount to obtain the final fuel injection amount.

In accordance with the above stated fundamental principles, an air-fuel ratio control or correction method for use in an internal combustion engine according to the present invention will be outlined by way of example.

Physical amounts indicating the load on the internal combustion engine and engine speed are detected, and a fuel supply amount during a transitional period of the internal combustion engine is controlled or corrected by using a fuel supply means for supplying a fuel amount corresponding to the above stated detection value of the physical amounts.

When the rate at which fuel adheres to an inner wall surface portion of an intake air flow passage is expressed as X, an evaporation time constant of the fuel which adheres to the inner wall surface portion of the intake air flow passage is expressed as $\tau$, and the fuel adhesion amount ratio (an adhesion time) of the fuel supply amount during a transition time to a fuel supply amount during the normal operational condition of the internal combustion engine is expressed as $\beta_f$, the fuel supply amount during the transitional period of the internal combustion engine is corrected or controlled in accordance with a transitional correction coefficient $K_f$ which is obtained by the following formulas (3) and (4).

$$\beta_{f(n)} = \left(1 - \frac{1}{\tau} \cdot \Delta T\right) \cdot \beta_{f(n-1)} + X \cdot \Delta T \cdot K_{f(n-1)} \quad (3)$$

$$K_f = \frac{1 - \frac{1}{\tau} \cdot \beta_{f(n)}}{1 - X} \quad (4)$$

wherein, $\Delta_T$: calculation cycle for the fuel adhesion amount ratio $\beta_f$, n: subscript indicating a calculation result of present time, n−1: subscript indicating a calculation result of a previous time.

Further, so as to easily and properly practiced the above stated method, an air-fuel ratio control or correction apparatus according to the present invention provides an execution means for calculating the transitional correction coefficient $K_f$ in accordance with the above stated calculation formulas (3) and (4), and fuel supply amount control means for controlling the fuel supply amount by using the above stated transitional correction coefficient $K_f$.

According to the method for controlling air-fuel ratio use in an internal combustion engine according to the present invention, since calculation of for a fuel injection amount, which is required to have high accuracy, and a complicated estimation calculation for an inner wall surface portion adhesion fuel amount are determined separately and independently, the estimation calculation in accordance with the above stated calculation formulas (3) and (4) assures a final fuel injection amount accuracy even in the case of one byte data processing.

Therefore, without a large load on the central processing unit (CPU) of the electronic control unit and a large memory capacity of the central processing unit (CPU) of the electronic control unit, the inner wall surface portion adhesion fuel amount can be estimated and the air-fuel ratio during the transitional period of the internal combustion engine can be compensated satisfactorily.

Further, since an apparatus for controlling an air-fuel ratio for use in an internal combustion engine according to the present invention provides a sensor for obtaining necessary data for the above stated execution means and an execution means necessary for the above stated execution, accordingly the air-fuel ratio control method can be practised easily and surely.

According to the present invention, the calculation with respect to the fuel injection amount which requires high accuracy and the calculation with respect to the inner wall surface portion adhesion fuel amount which requires complicated estimation can be carried out independently, respectively.

The fuel injection amount is controlled or corrected in accordance with the above stated inner wall surface portion adhesion fuel amount (estimation value), therefore an air-fuel ratio during the transitional period of the internal combustion engine can be maintained at a desirable value without a large load on the central processing unit (CPU) of the electronic control unit and also without requiring a large memory capacity in the electronic control unit.

DESCRIPTION OF THE INVENTION

One embodiment of a method for controlling an air-fuel ratio for use in an internal combustion engine according to the present invention will be explained with reference to the drawings.

The model calculation formulas described in the aforementioned U.S. Pat. No. 4,388,906 are the model calculation formulas (1) and (2) mentioned above.

Figure 1:
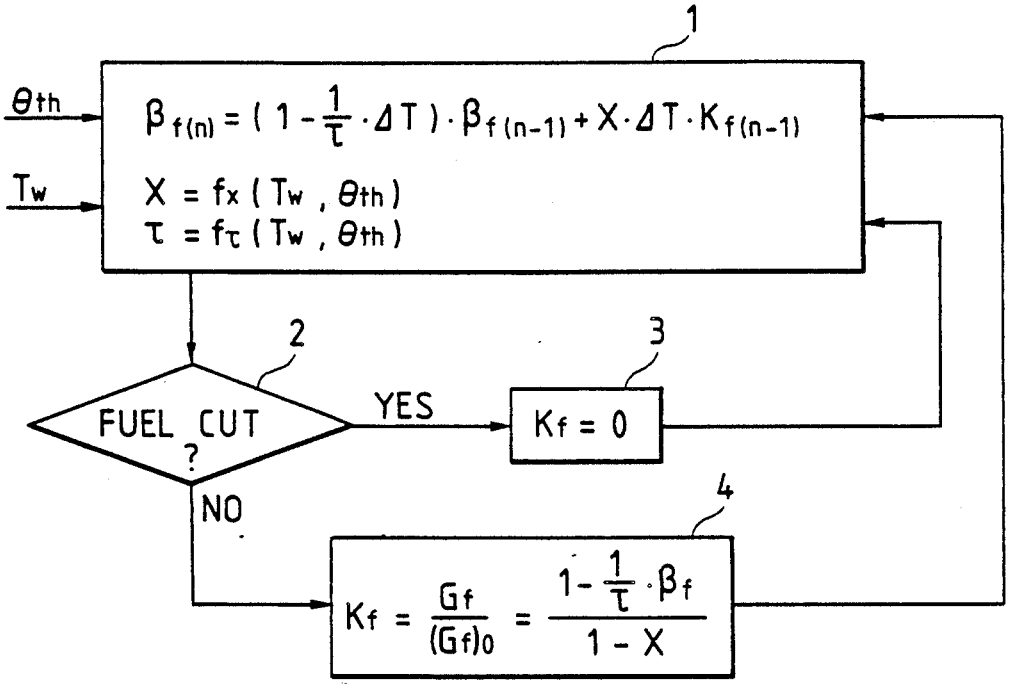
FIG. 1 is a block diagram showing one embodiment of a method for controlling air-fuel ratio in an internal combustion engine according to the present invention.

By dividing both sides of the model calculation formulas (1) and (2) by the supply fuel amount $(Gf)_o = -Q_a/(A/F)_o$ used during the normal operation of the internal combustion engine, the numerical calculation formula (3), which is related to the fuel adhesion time $\beta_{f(n)}$, indicated by a control step 1 of a flow-chart shown in FIG. 1, is obtained. Further, the numerical calculation formula (4) related to the transitional correction coefficient $K_f$ is indicated by a control step 4 of a flow-chart shown in FIG. 1.

Going into more detail with respect to the manner of obtaining the above mentioned numerical calculation formulas (3) and (4), the fuel supply amount $Q_a/(A/F)$ during the normal or steady state operation of the internal combustion engine is expressed as $(G_f)_o$. By dividing both sides of the above mentioned model calculation formulas (1) and (2) by the fuel supply amount $(G_f)_o$, the model calculation formula (1) is converted, so that $G_f/(G_f)_o$ is expressed as $K_f$(transitional correction coefficient) and the fuel adhesion amount $M_f/(G_f)_o$ is expressed as $\beta_f$, and thereby the above mentioned numerical calculation formulas (3) and (4) are obtained, respectively.

Figure 3:
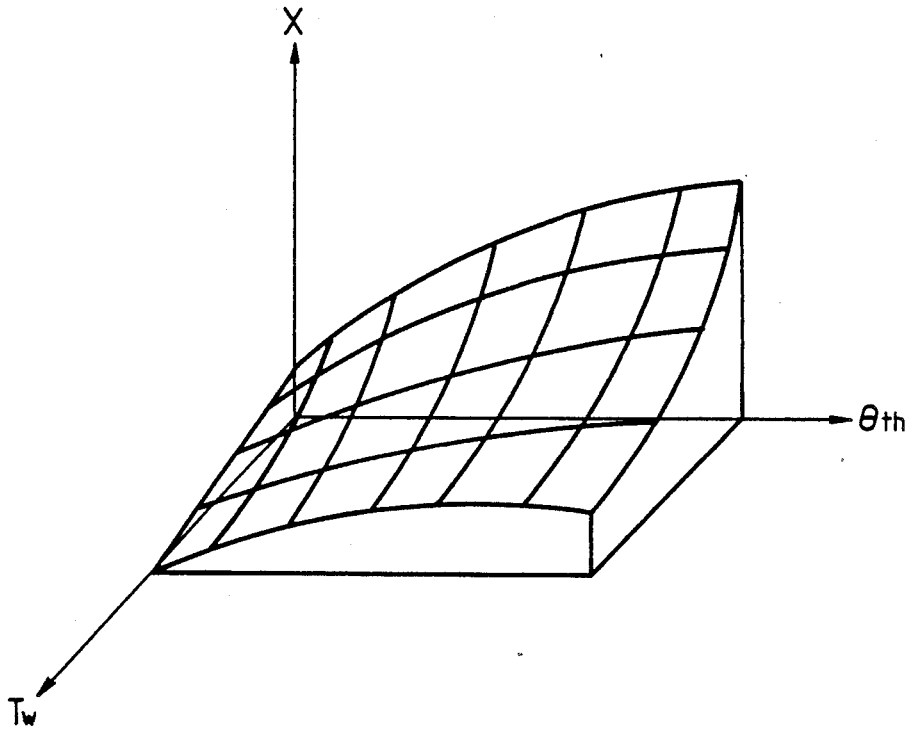
FIG. 3 is a three-dimensional diagram showing a characteristic of adhesion rate X for an inner wall surface portion of an intake manifold.

The rate X of adhesion of fuel to the inner wall surface portion of the intake air flow passage is determined mainly in accordance with the opening degree $\theta_{th}$ of the throttle valve and the engine temperature $T_w$. The fuel adhesion rate X has a characteristic as shown in FIG. 3.

Figure 4:
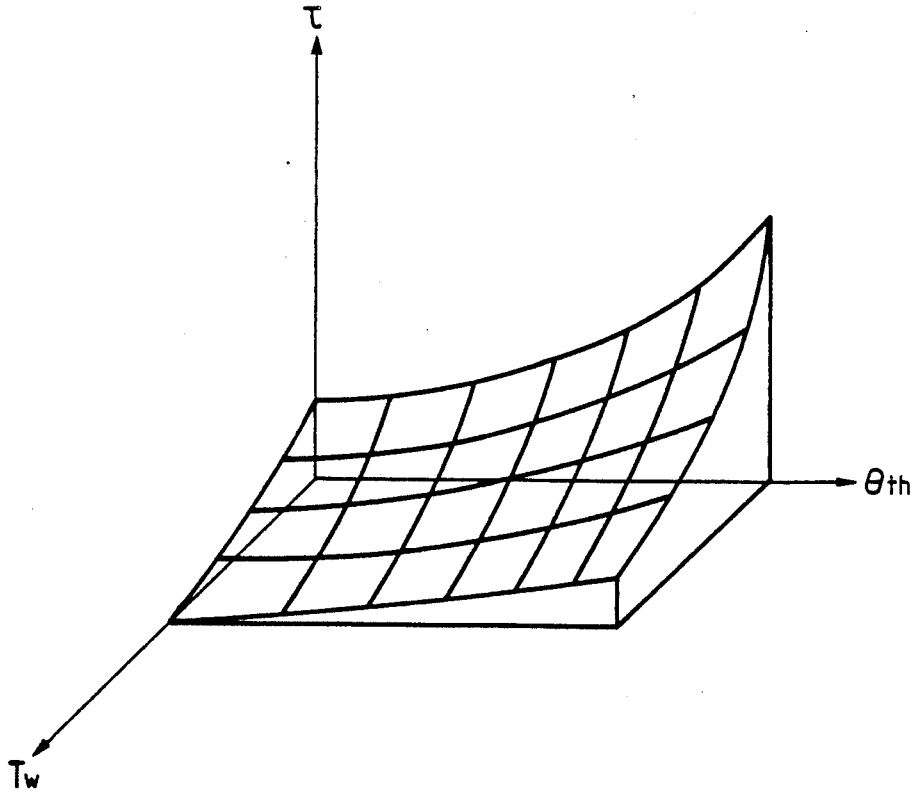
FIG. 4 is a three-dimensional diagram showing a characteristic of evaporation time constant $\tau$.

The evaporation time constant $\tau$ of the fuel which adheres to the inner wall surface portion of the intake air flow passage is determined mainly in accordance with the opening degree $\theta_{th}$ of the throttle valve and the engine temperature $T_w$. The evaporation time constant $\tau$ has a characteristic as shown in FIG. 4.

Namely, from the consideration of the qualitative values, the larger the engine temperature $T_w$ is low, the greater will be both the value of the adhesion rate X and the value of the evaporation time constant $\tau$. Also, the larger the value of the opening degree $\iota_{th}$ of the throttle valve is, the greater will be the value of the adhesion rate X and the value of the evaporation time constant $\tau$.

In place of the above stated opening degree $\iota_{th}$ of the throttle valve, the fuel adhesion rate X and the evaporation time constant $\tau$ may be determined by using an intake air flow amount $Q_a$, an intake pipe pressure, or a basic fuel injection pulse width $T_p$. Namely, a physical amount corresponding to the load on the internal combustion engine may be used therefor.

The calculations shown in FIG. 1 performed repeatedly at every predetermined calculation cycle $\Delta T$. In a control step 1 shown in FIG. 1, using the opening degree $\theta_{th}$ of the throttle valve and the engine temperature $T_w$, the fuel adhesion rate X and the evaporation time constant $\tau$ are determined in accordance with the characteristic shown in FIG. 3 and the characteristic shown in FIG. 4, respectively, and the fuel adhesion time $\beta_f$ is calculated therefrom.

In a control step 2 shown in FIG. 1, it is judged whether or not there is a fuel cut period. In case of a YES result, since the fuel supply is stopped, then in a control step 3 shown in FIG. 1 the transitional correction coefficient $K_f$ is made at zero ($K_f=0$) and the control step 3 is returned to the control step 1.

The stopping of the fuel supply i.e. a fuel cut is carried out in such a case where an automobile vehicle is operated under a deceleration operation, the vehicle speed of the automobile becomes abnormally high, or the engine speed N of the automobile vehicle becomes abnormally high etc.

In case of during a non-fuel cut period or in case of a NO result the control step 2, since the fuel is supplied normally into the combustion chamber of the internal combustion engine, in a control step 4 shown in FIG. 1 the transitional correction coefficient $K_f$ is calculated in accordance with the above stated calculation formula (4); and after the control step 4 the operation is returned to the control step 1.

Figure 2:
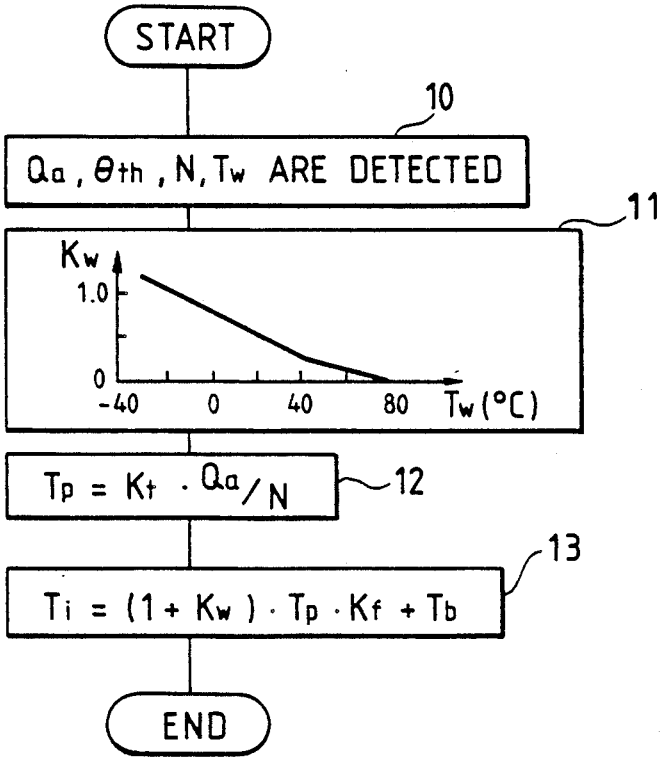
FIG. 2 is a flow-chart showing one embodiment of a calculation for fuel injection pulse width in a method for controlling air-fuel ratio in an internal combustion engine according to the present invention.

FIG. 2 is a flow-chart showing the calculation processing for calculating the fuel injection pulse width $T_i$. The fuel injection pulse width $T_i$ is set at every predetermined cycle.

In a control step 10 shown in FIG. 2, each of the intake air flow amount $Q_a$, the opening degree $\theta_{th}$ of the throttle valve, the engine speed N, and the engine temperature $T_w$ is detected. In a control step 11 shown in FIG. 2, the engine temperature correction coefficient $K_w$ is read out of memory in accordance with a map shown in the control step 11.

In a control step 12 shown in FIG. 2, the basic fuel injection pulse width $T_p$ is calculated in accordance with the calculation formula $T_p = K_f Q_a/N$. In a control step 13 shown in FIG. 2, the calculation processing shown in FIG. 1 is carried out repeatedly, and the fuel injection pulse width $T_i$ is determined by using the transitional correction coefficient $K_f$ which is renewed or updated successively. In the control step 13, $T_b$ is an electric power source voltage correction coefficient.

Figure 5:
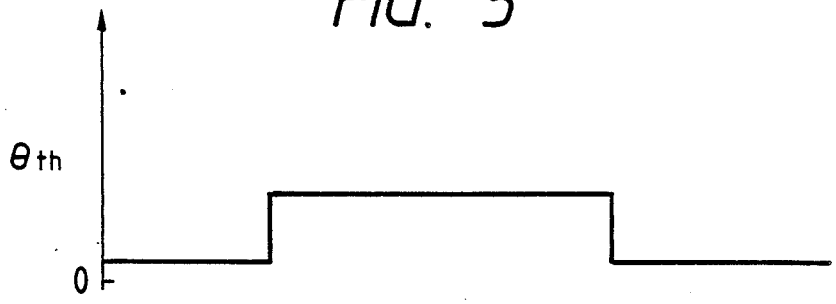
FIG. 5 is a diagram explaining the motion of a throttle valve opening degree $\theta_{th}$ of a throttle valve.
Figure 6:
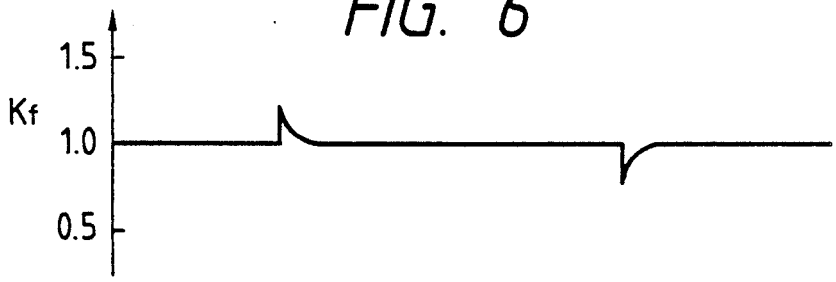
FIG. 6 is a diagram explaining variation of a transitional correction coefficient $K_f$.
Figure 7:
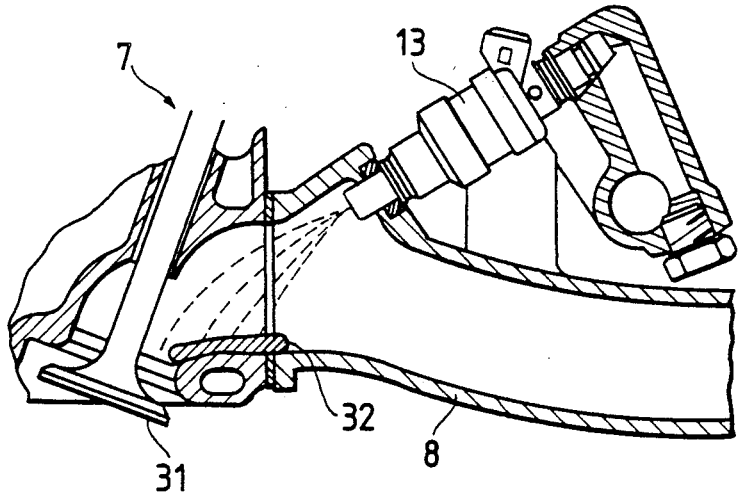
FIG. 7 is a partial cross-sectional view showing fuel adhesion of an injected fuel to an inner wall surface portion of an intake pipe.

FIG. 6 is an explanatory diagram showing changes in the value of the above stated transitional correction coefficient $K_f$. The transitional correction coefficient $K_f$ changes in accordance with the opening degree $\theta_{th}$ of the throttle valve shown in FIG. 5.

During the normal (stead state) operation period of the internal combustion engine, the calculation processing using the above stated calculation formula (3), converges to the following calculation formula (5).

$$\frac{1}{\tau} \cdot \beta_f = X \cdot K_f \tag{5}$$

Therefore, the transitional correction coefficient $K_f$ converges to a value of 1.0 in accordance with the above stated calculation formula (4).

In case of rapid acceleration from the normal operation period, the rate X of fuel adhesion to the inner surface portion of the intake air flow passage increases rapidly. On the other hand, in case of rapid deceleration from the normal operation period, the rate X of fuel adhesion to the inner surface portion of the intake air flow passage decreases rapidly.

Accordingly, since the fuel adhesion amount $\beta_f$ converges gradually in accordance with the above stated calculation formula (5), the value of the transitional correction coefficient $K_f$ becomes larger than 1.0 during the acceleration operation of the internal combustion engine. On the other hand, the value of the transitional correction coefficient $K_f$ becomes smaller than 1.0 during the deceleration operation of the internal combustion engine.

Accordingly, the fluctuation of the air-fuel ratio during the transitional period of the internal combustion engine can be controlled or corrected satisfactorily. Also, the fluctuation of the air-fuel ratio during the transitional period of the internal combustion engine can be compensated and a predetermined air-fuel ratio can be maintained.

One embodiment of an apparatus for controlling air-fuel ratio for use in an internal combustion engine according to the present invention will be explained in detail as follows with reference to FIG. 8 and FIG. 9.

Figure 8:
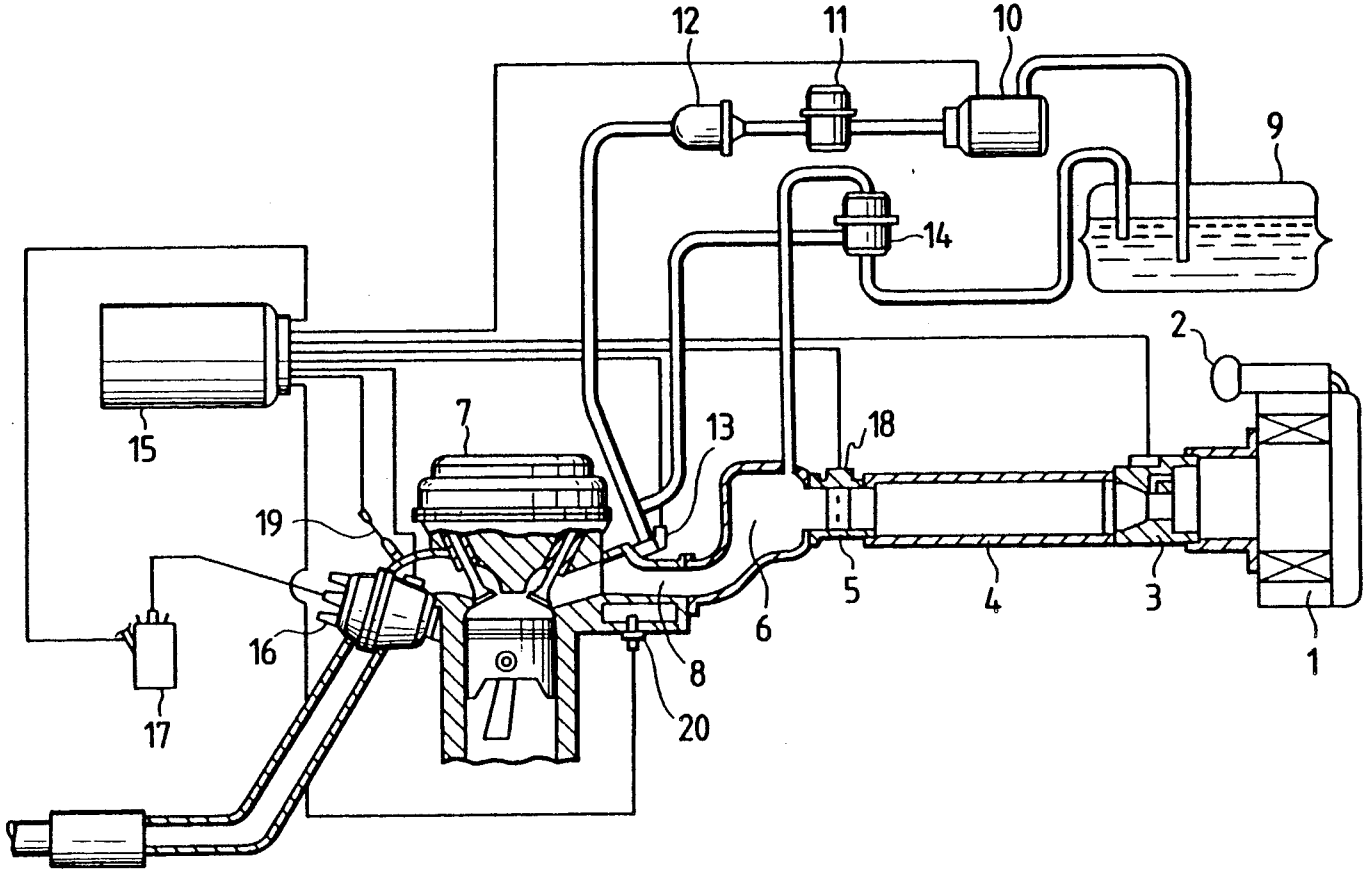
FIG. 8 is a constructional view showing an automatic engine control system for controlling an air-fuel ratio in an apparatus for controlling air-fuel ratio in an internal combustion engine according to the present invention.

In FIG. 8, air from an inlet portion 2 of an air cleaner 1 enters into a collector 6 via the hot wire type air flow meter 3 for detecting an intake air flow amount $Q_a$, a duct 4, and a throttle valve body 5 having a throttle valve for controlling the intake air flow amount $Q_a$. In the collector 6, the air is distributed into each intake pipe 8 which communicates directly with the gasoline internal combustion engine 7 and sucked into cylinders of the internal combustion engine 7.

Besides, fuel from a fuel tank 9 is pumped and pressurized by a fuel pump 10, and the fuel is supplied into a fuel supply system which comprises a fuel damper 11, a fuel filter 12, the fuel injector 13, and a fuel pressure control regulator 14. The fuel is controlled at a predetermined pressure value by the fuel pressure control regulator 14 and is injected into the respective intake pipe 8 through the fuel injector 13 disposed in the intake pipe 8.

Further, a signal for detecting the intake air flow amount $Q_a$ is outputted from the air flow meter 3. This output signal from the air flow meter 3 is supplied to the electronic control unit 15. A throttle valve sensor 18 for detecting an opening degree $\iota_{th}$ of the throttle valve is installed on the throttle valve body 5. The throttle valve sensor 18 works as a throttle valve opening degree detecting sensor and also as an idle switch. An output signal from the throttle valve sensor 18 is supplied to the electronic control unit 15.

A cooling water temperature detecting sensor 20 for detecting cooling water temperature of the internal combustion engine 7 is installed on a main body of the internal combustion engine 7. An output signal from the cooling water temperature detecting sensor 20 is supplied to the electronic control unit 15.

In a distributor 16, a crank angle detecting sensor is installed therein. The crank angle detecting sensor outputs a signal for use in detecting a fuel injection time, an ignition time, a standard signal, and the engine speed N. An output signal from the crank angle detecting sensor is inputted into the electronic control unit 15. An ignition coil 17 is connected to the distributor 16.

Figure 9:
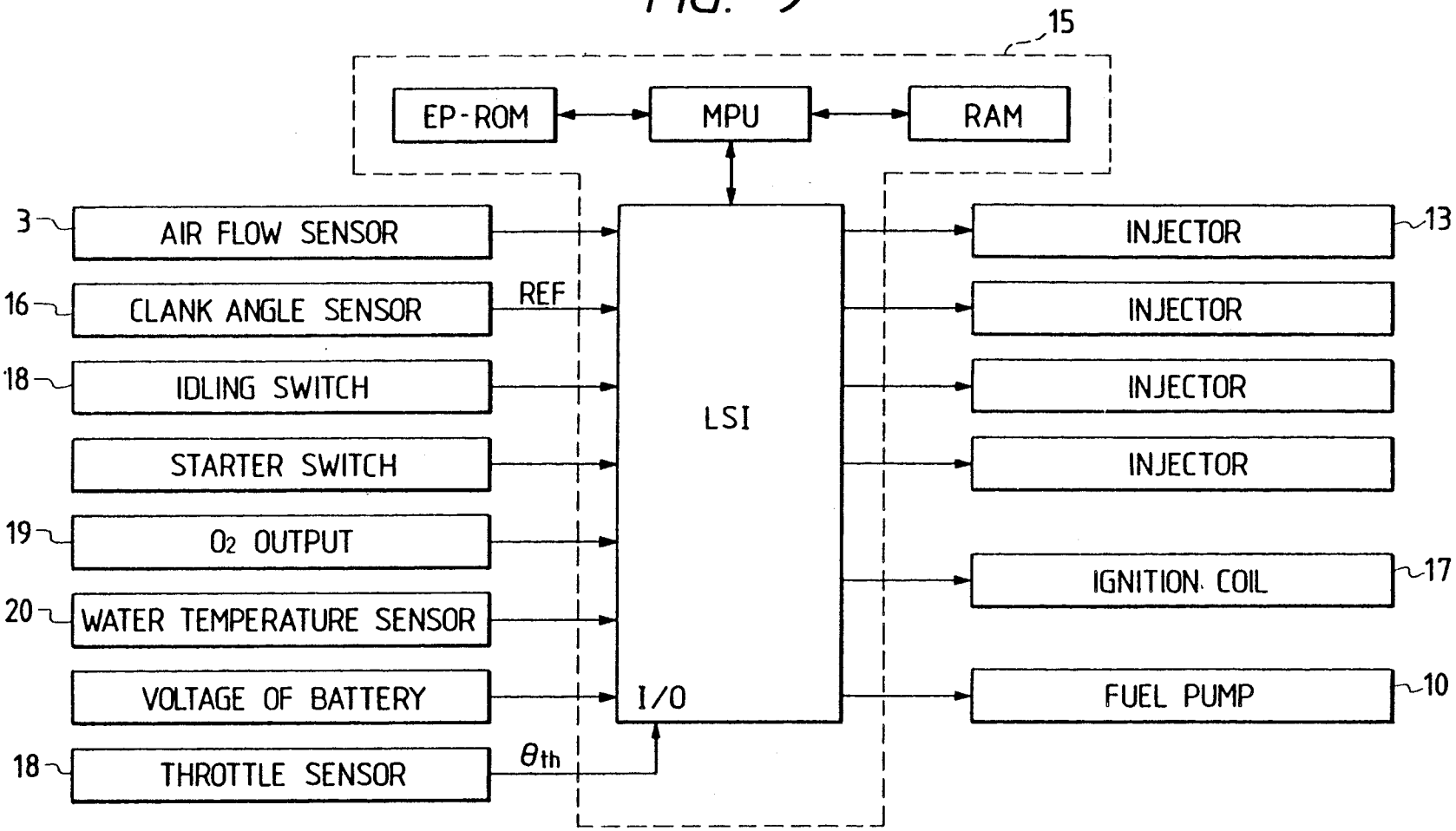
FIG. 9 is a block diagram showing an automatic engine control system for controlling air-fuel ratio in an electronic control unit and related apparatuses thereof shown in FIG. 8 according to the present invention.

The electronic control unit 15 comprises an execution apparatus including an MPU, EP-ROM, RAM, A/D convertor and input circuits as shown in FIG. 9. In the electronic control unit 15, a predetermined execution is carried out on the basis of through the output signal from the air flow meter 3, the output signal from the distributor 16 etc.. The fuel injector 13 is operated by the various output signals obtained by the execution results produced in the electronic control unit 15, and then the necessary amount fuel is injected into respective intake pipe 8.

We claim:

1. A method of controlling air-fuel ratio in an internal combustion engine, comprising the steps:

detecting operating parameters of said internal combustion engine including intake air flow amount, a physical quantity representing the load on the internal combustion engine and engine speed;

calculating at intervals $\phi T$ a fuel adhesion amount $\beta f$ corresponding to a ratio of an amount of fuel adhering to an inner wall surface portion of an intake pipe of the internal combustion engine during a transient state of operation of the engine to an amount of fuel supplied during steady state operation of the engine, using the following relationship:

$$\beta_{f(n)} = \left(1 - \frac{1}{\tau}\phi T\right) \cdot \beta_{f(n-1)} + X \cdot \phi T \cdot K_{f(n-1)}$$

where X is the rate of adhesion of fuel to said inner wall surface portion, $\tau$ is the evaporation time constant of fuel adhering to said inner wall surface portion, $\phi T$ is the calculation cycle time period and $K_f$ is a transitional correction coefficient;

calculating the transitional correction coefficient $K_f$, using the following relationship:

$$K_f = \frac{1 - \frac{1}{\tau} \cdot \beta_{f(n)}}{1 - X}$$

calculating a basic fuel injection amount using said detected operating parameters; and controlling air-fuel ratio during a transitional operating state of the internal combustion engine by adjusting said basic fuel injection amount using said calculated transitional correction coefficient $K_f$.

2. A method for controlling air-fuel ratio in an internal combustion engine according to claim 1, wherein the fuel adhesion rate X is determined in accordance with an opening degree of throttle valve and the engine speed of the internal combustion engine.

3. A method for controlling fuel ratio in an internal combustion engine according to claim 2, wherein the fuel adhesion rate X is obtained from a map of values stored in a memory unit indicating a characteristic of the opening degree of the throttle valve and a characteristic of the engine speed of the internal combustion engine for respective values of fuel adhesion rate X.

4. A method for controlling air-fuel ratio in an internal combustion engine according to claim 1, wherein the evaporation time constant $\tau$ is determined in accordance with an opening degree of a throttle valve and the engine speed of the internal combustion engine.

5. A method for controlling air-fuel ratio in an internal combustion engine according to claim 4, wherein the evaporation time constant $\tau$ is obtained from a map of values stored in a memory unit indicating a characteristic of the opening degree of the throttle valve and a characteristic of the engine speed of the internal combustion engine for respective values of evaporation time constant $\tau$.

6. An apparatus for controlling air-fuel ratio in an internal combustion engine, comprising:

means including a plurality of sensors for detecting operating parameters of said internal combustion engine including intake air flow amount, a physical quantity representing the load on the engine and engine speed;

means for calculating at intervals $\phi T$ a fuel adhesion time $\beta_f$ corresponding to an amount of fuel adhering to an inner wall surface portion of an intake pipe of the internal combustion engine during a transient state of operation of the engine to an amount of fuel supplied during steady state operation of the engine, using the following relationship:

$$\beta_{f(n)} = \left(1 - \frac{1}{\tau}\phi T\right) \cdot \beta_{f(n-1)} + X \cdot \phi T \cdot K_{f(n-1)}$$

where X is the rate of adhesion of fuel to said inner wall surface portion, $\tau$ is the evaporation time constant of fuel adhering to said inner wall surface portion, $\phi T$ is the calculation cycle time period and $K_f$ is a transitional correction coefficient;

means for calculating the transitional correction coefficient $K_f$, using the following relationship:

$$K_f = \frac{1 - \frac{1}{\tau} \cdot \beta_{f(n)}}{1 - X}$$

means for calculating a basic fuel injection amount using said detected operating parameters; and means for controlling an air-fuel ratio during a transitional operating state of the internal combustion engine by adjusting said basic fuel injection amount using said calculated transitional correction coefficient $K_f$.

7. An apparatus for controlling air-fuel ratio in an internal combustion engine according to claim 6, wherein the fuel adhesion rate X is determined in accordance with an opening degree of a throttle valve and the engine speed of the internal combustion engine.

8. An apparatus for controlling air-fuel ratio in a internal combustion engine according to claim 7, further including memory means for storing values of the fuel adhesion rate X in the form of a map of values indicating a characteristic of the opening degree of the throttle valve and a characteristic of the engine speed of the internal combustion engine for respective values of fuel adhesion rate.

9. An apparatus for controlling air-fuel ratio in an internal combustion engine according to claim 6, wherein the evaporation time constant $\tau$ is determined in accordance with an opening degree of a throttle valve and the engine speed of the internal combustion engine.

10. An apparatus for controlling air-fuel ratio in an internal combustion engine according to claim 9, further including memory means for storing values of the evaporation time constant $\tau$ in the form of a map of values indicating a characteristic of the opening degree of the throttle valve and a characteristic of the engine speed of the internal combustion engine for respective values of evaporation time constant $\tau$.

* * * * *